US009667005B2

(12) United States Patent
Pizzi

(10) Patent No.: US 9,667,005 B2
(45) Date of Patent: May 30, 2017

(54) BASE TERMINAL BLOCK AND AUXILIARY TERMINAL BLOCK FOR SWITCHBOARDS AND TWO-TIER TERMINAL BLOCK ASSEMBLY COMPRISING BASE TERMINAL BLOCK AND AUXILIARY TERMINAL BLOCK

(71) Applicant: MORSETTITALIA S.p.A., Milan (IT)

(72) Inventor: Giordano Pizzi, Milan (IT)

(73) Assignee: Morsettitalia S.p.A., Milan (IT)

( * ) Notice: Subject to any disclaimer, the term of this patent is extended or adjusted under 35 U.S.C. 154(b) by 0 days.

(21) Appl. No.: 15/016,739

(22) Filed: Feb. 5, 2016

(65) Prior Publication Data

US 2017/0025805 A1 Jan. 26, 2017

(30) Foreign Application Priority Data

Feb. 5, 2015 (IT) ..... M115A0151

(51) Int. Cl.
*H01R 25/14* (2006.01)
*H01R 9/26* (2006.01)
*H01R 9/24* (2006.01)

(52) U.S. Cl.
CPC ..... *H01R 25/142* (2013.01); *H01R 9/2408* (2013.01); *H01R 9/2416* (2013.01); *H01R 9/2675* (2013.01)

(58) Field of Classification Search
CPC ..... H01R 9/26; H01R 9/2608; H01R 9/2616; H01R 9/2625; H01R 9/2675; H01R 9/2683; H01R 9/2691
See application file for complete search history.

(56) References Cited

U.S. PATENT DOCUMENTS 5,318,461 A * 6/1994 Frikkee ..... H01R 9/2625 361/119
5,658,172 A * 8/1997 Schmidt ..... H01R 31/02 439/709

(Continued)

FOREIGN PATENT DOCUMENTS

| | | |
|---|---|---|
| DE | 295 02 186 U1 | 3/1995 |
| DE | 10 2008 009986 A1 | 7/2009 |
| EP | 2 204 886 A1 | 7/2010 |

OTHER PUBLICATIONS

Search Report and Written Opinion for Italian Application No. MI2015A000151, mailed Jun. 11, 2015.

*Primary Examiner* — Ross Gushi

(57) ABSTRACT

A switchboard base terminal block for connecting electrical wires comprising an insulating body having one top side and a bottom side opposite in a vertical direction, and at least two respective flanks opposite to each other in a longitudinal direction; wherein inside the body there is formed at least: a first pair of seats; a first space centered on a central vertical axis and bounded in the longitudinal direction by respective first partitions extending parallel to the vertical direction spaced from each other in the longitudinal direction by an amount such as to define a size of the space suitable for housing a jumper of the screw type; an undercut with base formed in the top side of the terminal block, presenting a first central opening for connecting externally the central space for insertion of the respective screw jumper, and means for coupling with corresponding means of an add-on terminal block for forming a two-tier terminal block in the vertical direction wherein said coupling means are adapted for determining a stable and non-decouplable along the vertical direction coupling with the corresponding coupling means of the add-on terminal block.

20 Claims, 6 Drawing Sheets

(56) References Cited

U.S. PATENT DOCUMENTS 5,820,420 A * 10/1998 Bechaz ..... G02B 6/389 439/532
5,853,304 A * 12/1998 Landreau ..... H01R 31/085 439/716
6,146,213 A * 11/2000 Yoon ..... H01R 9/2616 439/532
6,183,311 B1 * 2/2001 Suess ..... H01R 4/4845 439/716
6,478,605 B2 * 11/2002 Stuckmann ..... H01R 9/26 439/395
6,488,527 B2 * 12/2002 Yoon ..... H01R 9/2675 439/441
6,500,021 B2 * 12/2002 Wilmes ..... H01R 9/26 439/395
6,506,071 B2 * 1/2003 Lange ..... H01R 9/26 439/358
6,655,982 B2 * 12/2003 Bolliger ..... H01R 4/2433 439/395
6,733,330 B2 * 5/2004 Prost ..... H01R 13/639 439/532
7,192,316 B1 * 3/2007 Pollmann ..... H01R 9/2675 439/716
7,658,639 B2 * 2/2010 Hoppmann ..... H01R 4/4827 439/142
7,666,037 B2 * 2/2010 Diessel ..... H01R 9/2616 439/716
7,686,626 B2 * 3/2010 Wu ..... H01R 4/64 439/95
7,686,627 B2 * 3/2010 Wu ..... H01R 9/2691 439/95
7,690,952 B2 * 4/2010 Koellmann ..... H01R 9/26 439/716
7,862,389 B2 * 1/2011 Pizzi ..... H01R 4/28 439/709
7,892,032 B2 * 2/2011 Pizzi ..... H01R 13/68 439/620.33
7,922,521 B1 * 4/2011 Wu ..... H01R 9/2691 439/532
8,128,430 B2 * 3/2012 Diessel ..... H01R 9/2675 439/507
8,460,038 B2 * 6/2013 Eisert ..... H01R 9/2625 439/716
8,482,423 B2 * 7/2013 Jonsson ..... H01R 9/2625 340/651
8,517,758 B2 * 8/2013 Pizzi ..... H01R 9/2683 439/491
8,647,157 B2 * 2/2014 Gan ..... H01H 50/048 439/507
8,771,007 B2 * 7/2014 Reibke ..... H01R 9/2675 439/189
9,083,115 B2 * 7/2015 Hoppmann ..... H01R 4/4827
9,300,060 B2 * 3/2016 Niemann ..... H01R 9/2625
9,306,298 B2 * 4/2016 France ..... H01R 9/2608
9,455,509 B2 * 9/2016 Goerlitzer ..... H01R 9/2625
9,525,218 B2 * 12/2016 Wu ..... H01R 4/4818
2003/0045178 A1 * 3/2003 Huiskamp ..... H01R 4/24 439/709
2008/0233782 A1 * 9/2008 Hoppmann ..... H01R 4/4827 439/259
2008/0248698 A1 * 10/2008 Pizzi ..... H01R 13/68 439/709
2010/0203773 A1 * 8/2010 Henke ..... H01R 9/2633 439/709
2014/0113502 A1 * 4/2014 Barber ..... H01R 4/4836 439/709
2014/0127932 A1 * 5/2014 Hoppmann ..... H01R 4/4827 439/370
2016/0056599 A1 * 2/2016 Peach ..... H01R 9/2666 439/508
2016/0233593 A1 * 8/2016 Pizzi ..... H01R 9/26
2017/0025804 A1 * 1/2017 Pizzi ..... H01R 25/142
2017/0025805 A1 * 1/2017 Pizzi ..... H01R 25/142

* cited by examiner

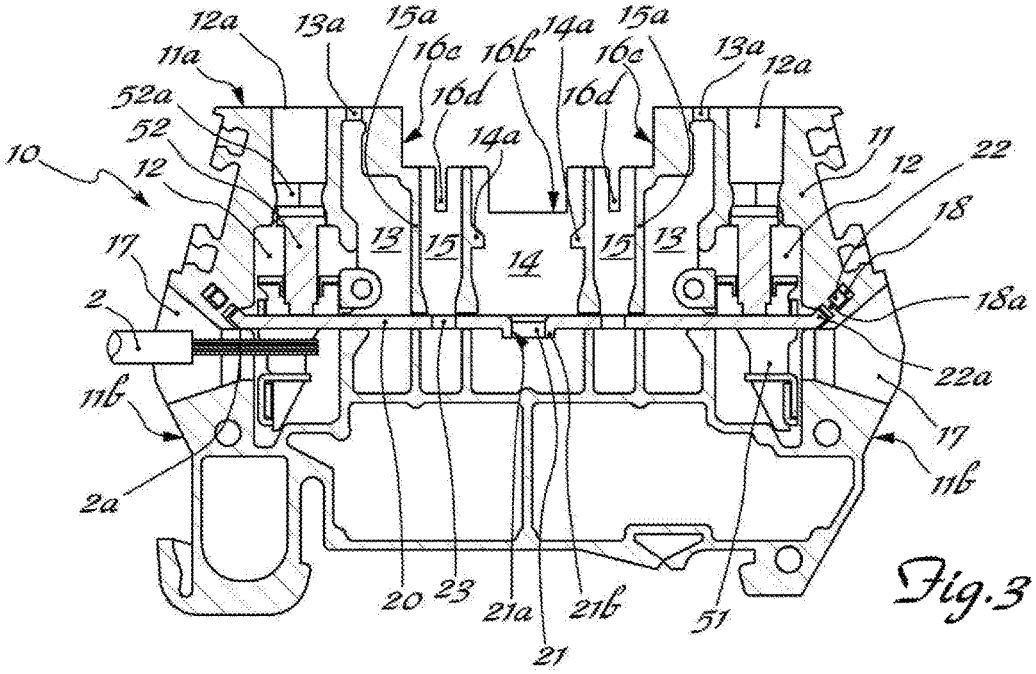
Fig.3
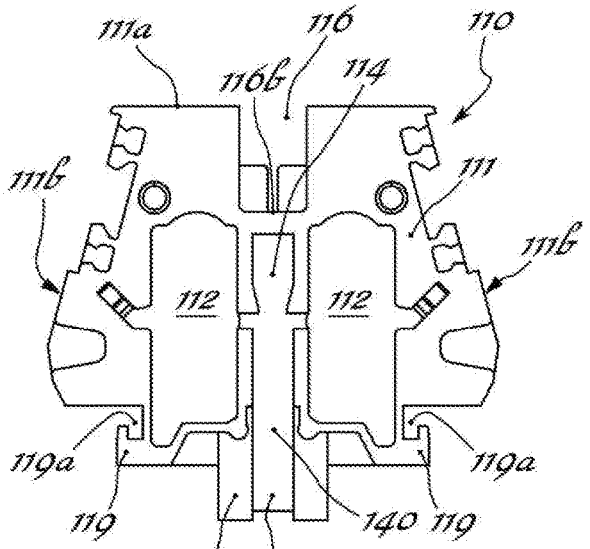
Fig.4
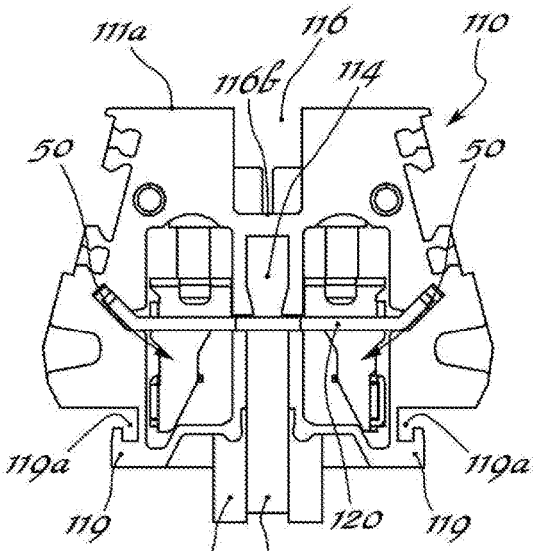
Fig.5
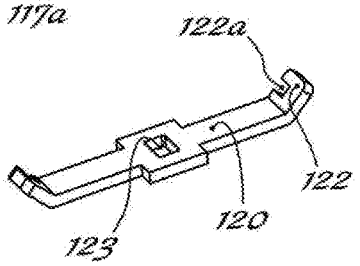

200
19a
19
19
19a
12a
12a
10
119
119
117
116
20
51
51

200
19a
19
19
19a
12a
12a
10
119
119
14a
14a
225
225
116
20
224c
224c
51
15
51

BASE TERMINAL BLOCK AND AUXILIARY TERMINAL BLOCK FOR SWITCHBOARDS AND TWO-TIER TERMINAL BLOCK ASSEMBLY COMPRISING BASE TERMINAL BLOCK AND AUXILIARY TERMINAL BLOCK

FIELD OF THE INVENTION

The present invention relates to a switchboard terminal block for connecting electrical wires.

BACKGROUND OF THE INVENTION

It is known, in the technical sector relating to the production of switchboards for the wiring of electrical installations, to use terminal blocks designed to be mounted on associated supports, such as DIN-standard rails, and to provide on the front side access to the means—normally of the screw or spring type—for retaining electrical wires to be connected in order to restore continuity of the various sections of the electric circuit; said continuity being achieved by inserting inside a special seat, accessible from the front side, movable contact elements such as protection fuses, electric circuit breakers or jumpers for connecting together two or more adjacent terminal blocks.

It is also known that these connection jumpers may be:

- configured with two spring lugs forming the element for coupling inside the seat of the terminal block assembly, with associated electrical contact in the longitudinal direction determined by the resilient force which pushes the lugs the walls of a hole in a longitudinal conductor lamina connecting together the means for retaining the electrical wires; or
- of the screw type, with a conductor body in the form of an "overturned U", providing electrical contact in the vertical direction by means of contact of the feet of the conductor body with the longitudinal conductor lamina connecting the opposite means for retaining the electrical wires, said contact being determined by tightening a screw inside the female thread of a hole formed in the said conductor lamina.

The two types of connection jumper have different dimensional measurements both in the transverse direction of the width/thickness of the terminal block and in the longitudinal lengthwise direction of the terminal block.

It is also known that the increasingly greater demand for connections and branched junctions both in the electrotechnical sector and in the electronics sector, where it is required to direct also the control signals, results in the design of electric switchboards which have increasingly larger dimensions and consequently occupy a greater amount of space in the installation premises, resulting in greater costs due to the larger dimensions also of the installation cabinets.

EP 2 204 886 A1 describes a terminal block with a central space divided into two sub-spaces by a central dividing wall for receiving the separate legs of a shunt which may be for example a fuse, a relay or a signalling lamp. The configuration of the central space is such as to allow the insertion and subsequent extraction of the shunt in the vertical direction.

DE 10 2008 009986 describes a terminal block which has a detent lug corresponding to a detent hook of a detent arm formed near to a socket for a connection plug. The lug engages the detent hook of the detent arm in a reversibly locked condition of the connection plug in the socket, which plug may be extracted vertically from the socket by acting on the detent arm.

DE 295 02 186 U describes a terminal block assembly with means for reversible coupling in the direction of insertion of an electric connector.

All the cited documents illustrate electrical connection components to be inserted in a base terminal block, which by their very nature must be able to be subsequently extracted with ease from the base terminal block along the direction of insertion therein.

The technical problem which is posed, therefore, is to provide a terminal block, in particular of the type for wired-circuit switchboards, which allows the connection/branching capacity of the switchboard to be increased without having to increase its dimensions in particular in the longitudinal direction of the width, but preferably also thickness.

In connection with this problem, it is also required that this terminal block should have small dimensions and be able to be produced and assembled in an easy and low-cost manner and that it should be designed to avoid errors during the insertion of the different electrical contact jumpers with the consequent possibility of damage to the connected circuits.

SUMMARY OF THE INVENTION

These results are obtained according to the present invention by a base terminal block for connecting electrical wires, in particular for electric switchboards, designed for coupling in the vertical direction with an auxiliary terminal block so as form a multiple, modular, two-tier terminal block according to the features of the claims.

The present invention relates furthermore to an auxiliary or "add-on" terminal block which can be engaged with the base terminal block, for the connection of electrical wires in particular for electric switchboards, according to the features of the claims, and a two-tier base and add-on terminal block assembly according to the features of the claims.

BRIEF DESCRIPTION OF THE DRAWINGS

Further details may be obtained from the following description of non-limiting examples of embodiment of the subject of the present invention, provided with reference to the accompanying drawings, in which:

FIG. 3: shows a cross-sectional view, along a vertical plane, of a third embodiment of the base terminal block according to the invention with the longitudinal electrical connection lamina inserted;

FIG. 4: shows a side view from the wide side of an add-on terminal block according to the present invention;

FIG. 5: shows a side view similar to that of FIG. 4 of the add-on terminal block according to the invention assembled with the longitudinal electrical connection lamina and means for retaining the electrical wires;

DETAILED DESCRIPTION OF THE INVENTION

As shown, for the sake of easier description and without a limiting meaning, a set of three reference axes are assumed, i.e. in the longitudinal direction X-X, corresponding to the lengthwise dimension of the terminal block; transverse direction Y-Y, corresponding to the width or thickness of the terminal block; and vertical direction Z-Z, corresponding to the heightwise dimension of the terminal block and the direction of superimposition of an add-on terminal block on top of a base terminal block, and for easier illustration coinciding with the central vertical axis of the terminal block.

For the sake of easier description, and using the directional layout shown in the figures by way of example, the following are also assumed: a bottom part corresponding to the part of the base terminal block for coupling with a DIN-standard rail B (FIG. 1) fixed to the electric switchboard (not shown) and a top part, opposite to the first part, corresponding to the visible side of the terminal block accessible by the user.

According to the invention, it is envisaged that the terminal block comprises (FIG. 1) an insulating body 10 forming a frame 11 substantially in the form of a closed ring and configured so as to define at least one front facing side 11*a* and at least two respective flanks 11*b* arranged opposite each other in the longitudinal direction X-X.

As will emerge more clearly below, the terminal block may be completed so as to form the various electrical connections in the longitudinal direction X-X between the opposite wires 2 by means of:

- a conductor lamina 20 extending in the longitudinal direction X-X for restoring the electrical continuity between the electrical wires 2 inserted in the opposite flanks of the terminal block.

Figure 1:
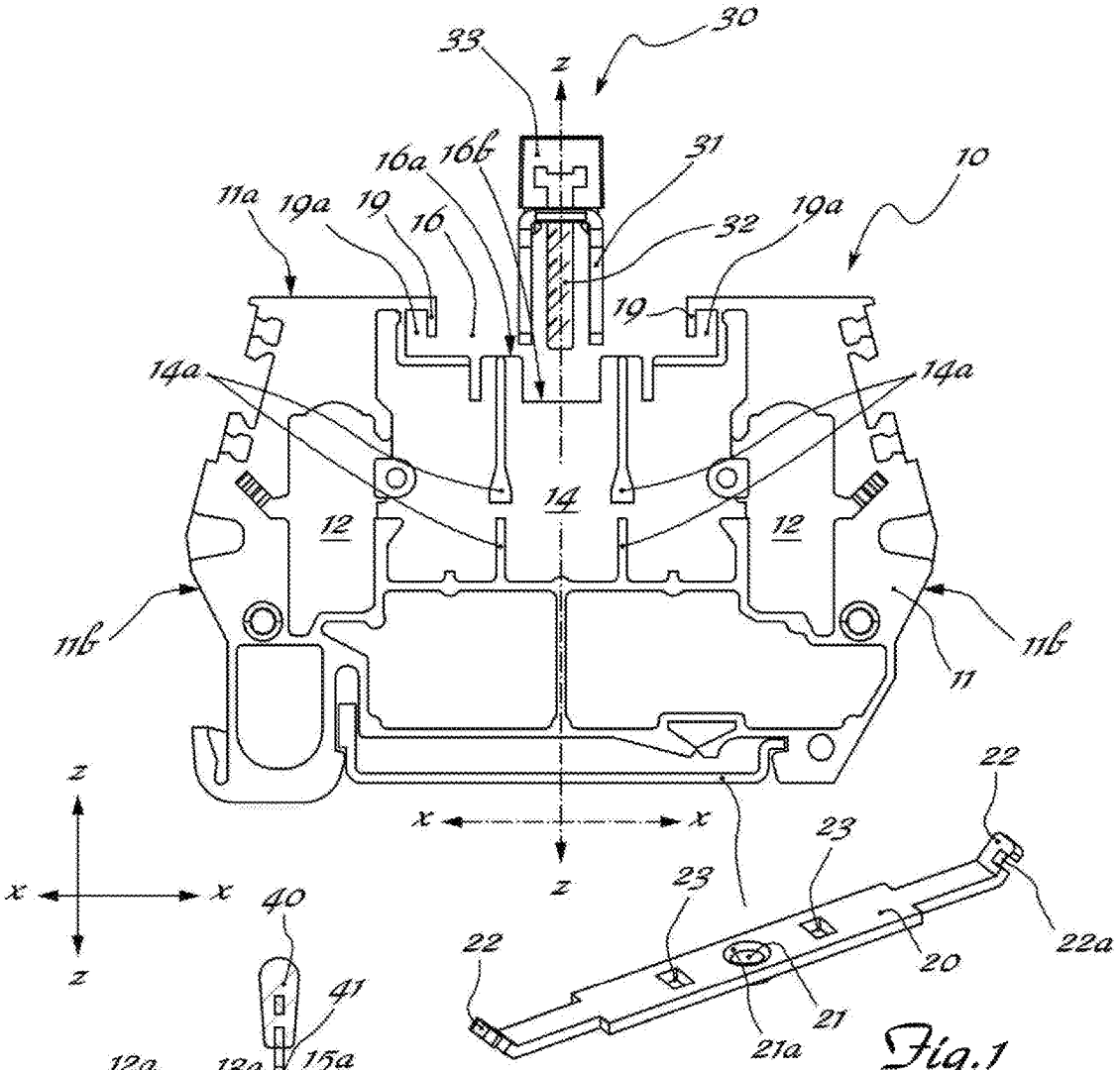
FIG. 1: shows an exploded side view of a first embodiment of the base terminal block according to the present invention.

In its minimum configuration shown in FIG. 1, the following are formed inside the body 10:

- at least one first pair of seats 12 situated outermost in the longitudinal direction X-X, towards the flanks 11*b* and open in a transverse direction Y-Y and preferably symmetrical with respect to a vertical central axis Z-Z, suitable for housing means 50 (FIG. 3) for retaining the ends 2*a* of the electrical wires 2 which can be introduced in the longitudinal direction X-X into the terminal block 10 through respective openings 17 formed in the narrow side flanks 11*b*.

The front wall 11*a* of the frame 11 also has, formed therein, first openings 12*a* extending in the vertical direction Z-Z and in the longitudinal direction X-X, substantially arranged above the respective seat 12 and designed to connect the latter with the exterior, for the introduction of means for operating the retaining means 50;

- at least one space 14 centered on the vertical central axis Z-Z and bounded in the longitudinal direction X-X by respective vertical partitions 14*a* interrupted in the vertical direction Z-Z along a section with a height such as to allow insertion of the conductor lamina 20 suitable for restoring the electrical continuity between the opposite wires 2; the vertical partitions 14*a* are spaced from each other in the longitudinal direction X-X by an amount such as to define a size of the space suitable for housing a jumper 30 of the type with screw 32 and with conductor body in the form of an "overturned U" having vertical legs 31 and insulating body 33 for containing the head of the screw.

Figure 2:
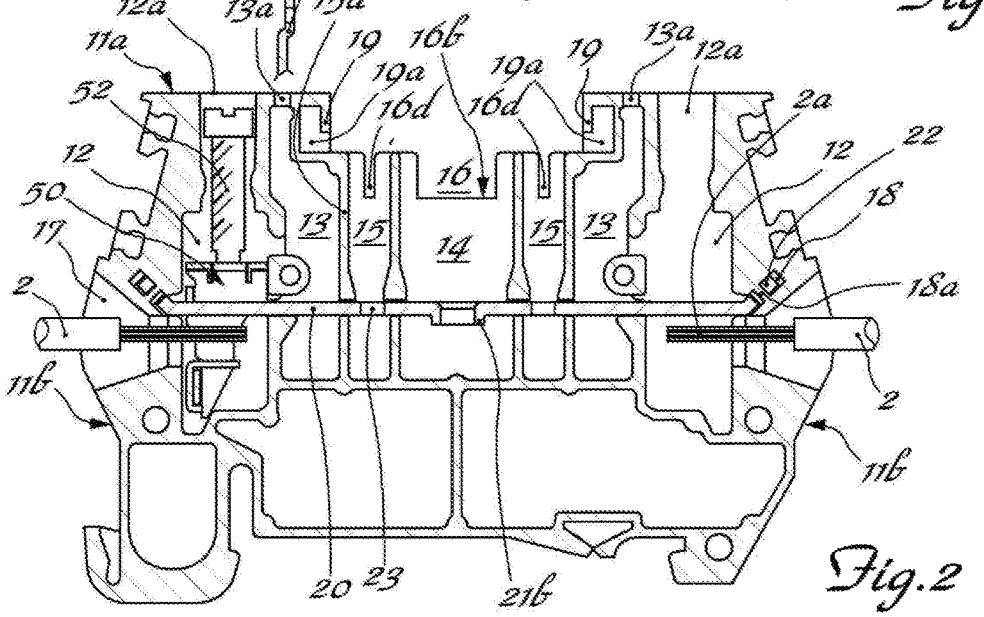
FIG. 2: shows a cross-sectional view, along a vertical plane, of a second embodiment of the base terminal block according to the invention with the longitudinal electrical connection lamina inserted.

FIG. 2 shows a further embodiment of the base terminal block according to the invention which is provided internally with the following:

- preferably, a second pair of seats 13 which are situated more externally with respect to the central space 14 in the longitudinal direction X-X, towards the flanks 11*b*, and are open in the transverse direction Y-Y and symmetrical with respect to the vertical central axis Z-Z;
- the second seats 13 are connected to the exterior via a respective hole 13*a* with vertical axis which is open on the top surface 11*a* for housing means for fixing a tag for identification of the connection performed;
- a pair of second spaces 15 respectively arranged symmetrically on opposite sides of the central space 14; each second space 15 is bounded in the longitudinal direction by respective second partitions 15*a* interrupted in the vertical direction Z-Z along a section with a height such as to allow the insertion of the conductor lamina 20; the partitions 15*a* are spaced in the longitudinal direction X-X from the first partitions 14*a* by an amount such as to define a size of the space suitable for housing a respective jumper 40 of the type with spring lugs 41.

The screw jumper 30 and/or spring-lug jumper 40 is/are designed to establish an electrical contact between the terminal block and one or more additional terminal blocks adjacent to it in the transverse direction Y-Y, and are not described in detail since they are of the conventional type.

Along the top side 11*a*, the terminal block has an undercut 16*a* with base 16*a* having a first central opening 16*b* for inserting in the vertical direction Z-Z, from the front side 11*a* accessible for the operator also once the terminal block has been mounted on the electric switchboard, the conductor body of a screw-type jumper 30.

In the case of a terminal block with spaces 15 for housing a spring-lug jumper 40, the bottom of the undercut 16 has two second lateral openings 16*c* arranged on opposite sides of the central opening 16*b*. The three openings 16*b* and 16*c* form the openings towards the top side 11*a* of the first space 14 and, where present, of the pair of spaces 15, respectively.

According to the invention, it is envisaged that in all its embodiments the base terminal block has means for coupling with corresponding means of an auxiliary or "add-on"

terminal block described below, without the possibility of movement or extraction in the vertical direction along which the two terminal blocks are arranged on top of each other.

In a first embodiment of the base terminal block according to the invention (FIGS. 1,2), it is envisaged that said coupling means consists of a pair of teeth 19 in the form of an "overturned L" formed on the outermost wall of the opposite vertical edges 16*c* of the undercut 16 in the frame 11 of the terminal block; each tooth 19 forms a respective L-shaped inset seat 19*a* formed in the respective vertical edge 16*c* of the undercut 16.

In a second preferred embodiment of the base terminal block according to the invention (FIG. 3), which has a frame 11 similar to that shown in FIG. 2 and for which the same reference numbers will be used for the parts which remain unchanged, it is envisaged that said coupling means comprise at least one tooth 14*c*, which is preferably rigid and extends from each vertical partition 14*a* towards the inside of the space 14; as will become clearer below, the two teeth 14*c* are designed to cooperate with corresponding complementary means—preferably deformable resiliently in the longitudinal direction X-X—of an add-on terminal block, so as to determine coupling of the add-on terminal block to the base terminal block in a fixed manner in the vertical direction without the possibility of the former being able to be extracted from the latter in the vertical direction.

The said conductor lamina 20, which during use connects the two opposite wires 2 together, extends in the longitudinal direction X-X.

Preferably, the opposite free ends of the lamina form a tip 22 inclined upwards and designed to engage with a corresponding internal seat 18 provided on each flank 11*b* of the frame 11 so as to stably fasten the conductor lamina 20 to the insulating body 10.

Preferably, each tip 22 has an incision 22*a* designed to engage with a corresponding relief 18*a* in the seat 18 in order to axially retain the lamina when it undergoes an axial deformation owing to the thrust exerted by the screw 52 of the means 50 for retaining the wire 2.

The conductor lamina 20 has a first central hole 21, with female thread 21*a* designed to mate with the thread of the screw 32 of the jumper 30.

Preferably, for the embodiment shown in FIGS. 2 and 3 designed for insertion of the spring lugs 40, the lamina 20 has a further pair of openings 23 with a polygonal—preferably quadrangular—shape as shown, symmetrically arranged on opposite sides of the central holes 21 for coupling with the lugs 41 of the spring jumper 40.

During use (FIG. 2) the hole 21 and the openings 23 will be respectively coaxial with the spaces 14 and 15 so as to allow the conductive connection with the corresponding jumper 30 or 40, once it has been fully inserted inside the terminal block.

Preferably, the central hole 21 is obtained by means of deep-drawing so as to form an extended collar 21*b* in the vertical direction Z-Z designed to allow further screwing of the screw 31 of the jumper 30 and favour a better conductive contact.

In the examples shown, the means 50 for retaining the electric wire 2 are of the clamp type 51 with actuating screw 52; the head 52*a* of said screw 52 is accessible from the outside via said vertical-axis hole 13*a* through which it is possible to insert the operating tool for rotating the screw, the tip of which, reacting against the surface of the lamina 21, recalls the clamp 51 which grips the end 2*a* of the wire 2 between clamp and lamina.

Although not shown, it is envisaged that the means for retaining the wire 2 may be of the spring type which can be operated with or without a suitable operating button.

As shown:

- the laterally open terminal block 10 is assembled by inserting inside it in the transverse direction Y-Y:
  - the conductor lamina 20, so that its opposite raised ends enter inside the respective seat of the terminal block;
  - the means 50 for retaining the wire 2;
- closing the terminal block with a cover, not shown;
- inserting the wires 2 longitudinally inside the respective insertion seats 17 and operating the actuating screw of the retaining means so as to grip the said wires against the conductor lamina;
- if required, it is possible to connect several terminal blocks arranged adjacent in the transverse direction Y-Y by inserting at least one of the screw jumper 30 or spring-lug jumper 40 inside the respective seat 14 or 15;
- in the case of a screw jumper, the said screw is operated so that its thread engages with the female thread 21*a* of the hole 21 in the lamina 20 and the conducting legs of the jumper are pressed against the said lamina;
- in the case of a jumper 40 with spring lugs 41, this is pushed down fully in the vertical direction of insertion so that the spring lugs enter inside the respective opening 23 and produce the electrical conductive contact by means of the resilient thrust of the contact legs against the internal surface of the openings 23 of the lamina 20.

The present invention also relates to an auxiliary or "add-on" terminal block suitable for coupling with the base terminal block already described.

Figure 6:
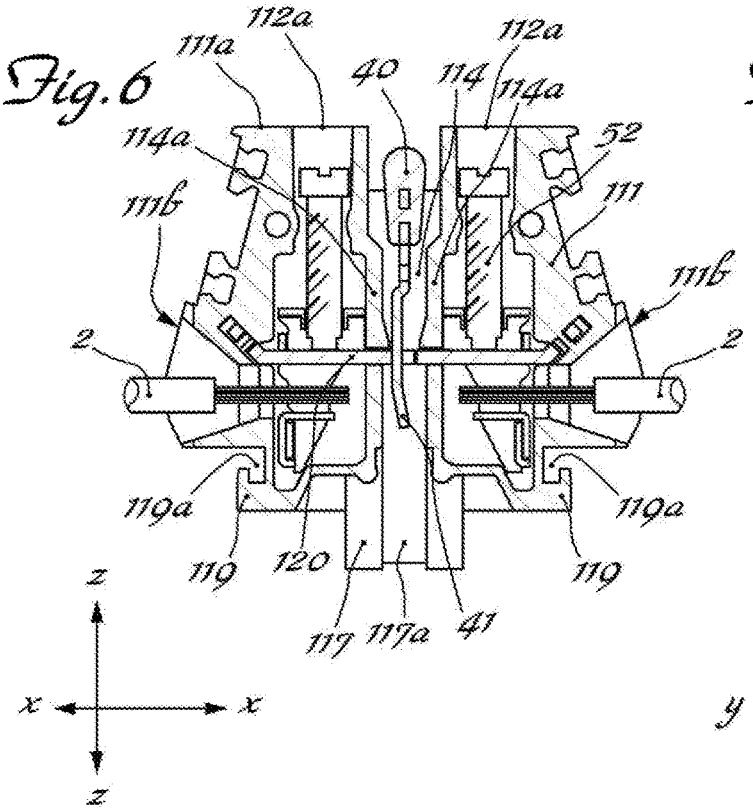
FIG. 6: shows a cross-section, along a vertical plane, of the terminal block according to FIG. 5 with jumper inserted.
Figure 7:
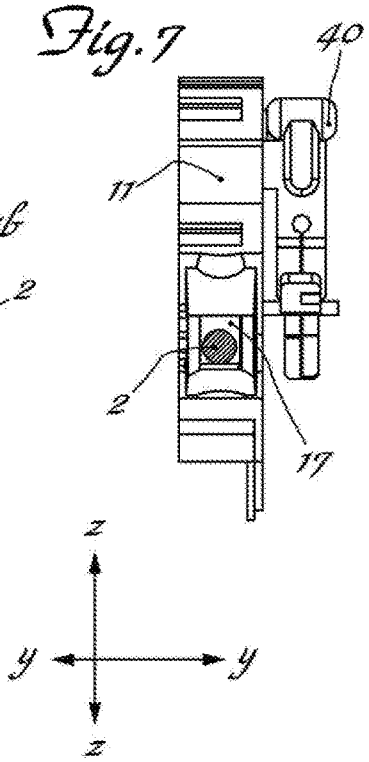
FIG. 7: shows a side view of the terminal block according to FIG. 6.

In a first embodiment (FIGS. 4-7), the add-on terminal block comprises an insulating body 100, the closed-ring frame 111 of which has a central seat 114 with opening 114*a* directed towards the top surface 111*a* of the terminal block for housing a movable contact element. In the example shown (FIG. 6), said contact element is a jumper 40 with spring lugs; correspondingly, the longitudinal conductor lamina 120 has a single polygonal opening 123 coaxial with the central seat 114 for allowing insertion of the resilient lugs 41 of the jumper 40 and the consequent electrical conduction contact, as already described.

The other parts of the top terminal block 100 are similar to those of the bottom terminal block and are therefore indicated by identical reference numbers preceded by 1, but are not described in detail.

In the first embodiment of the add-on terminal block, it is envisaged that it has, in its bottom part, a pair of substantially L-shaped projections 119 projecting outwards in the longitudinal direction X-X and forming a respective inner seat 119*a* in the form of an "overturned L".

The projections 119 and the seats 119*a* of the add-on terminal block are complementary and correspond to the projections 19 and seats 19*a* of the base terminal block, in order to allow the respective and corresponding insertion in the transverse direction Y-Y and, therefore, relative coupling designed to form an assembled unit with two tiers (the directional layout shown in the figures is not limiting), i.e., an upper tier (add-on terminal block) and bottom tier (base terminal block) which are fixed and cannot be disengaged from each in the vertical direction Z-Z along which they are arranged one on top of the other.

In greater detail, the two-tier assembly is realized by joining together the coupling means of the top part of the base terminal block with the complementary coupling means of the bottom part of the add-on terminal block.

Preferably the add-on terminal block also has flanges 117 extending in the vertical direction Z-Z from the transverse peripheral edges of its bottom part and located in a central position with respect to the two projections 119; the flanges are designed to form elements for ensuring guiding and mechanical stabilization as well as electrical insulation once engaged.

Figure 8:
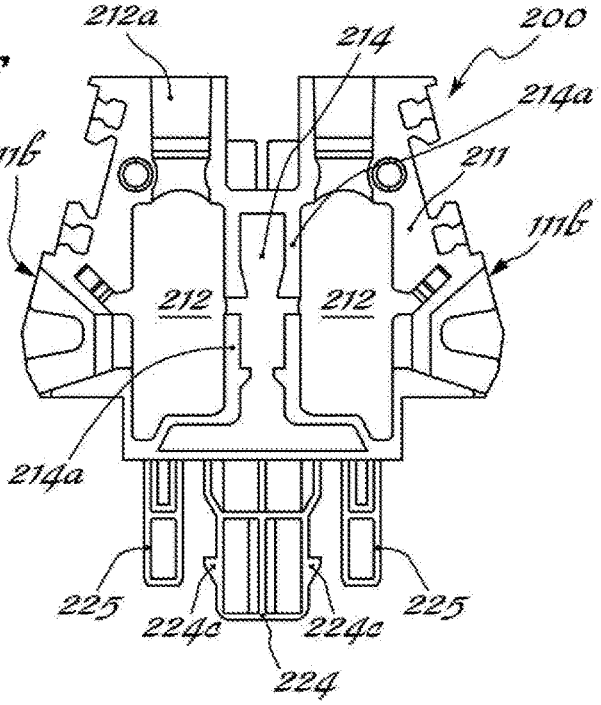
FIG. 8: shows a side view from the wide side of a second embodiment of the add-on terminal block according to the present invention.

According to a further embodiment of the add-on terminal block (FIG. 8), it is envisaged that the bottom part of the frame 211 of the insulating body 200 has means for coupling with the corresponding means 14*c* of the base terminal block, designed to allow relative coupling in the vertical direction Z-Z.

In this embodiment, the coupling means comprise:

at least one protrusion 224 projecting in the vertical direction Z-Z from the bottom surface of the add-on terminal and provided with two teeth 224*c* respectively projecting outwards in the longitudinal direction X-X; the two teeth 214*c* are preferably deformable resiliently in the longitudinal direction X-X and formed at a height in the vertical direction Z-Z such as to allow coupling with the rigid teeth 14*c* of the base terminal block, without the possibility of relative movement or extraction in the vertical direction, once relative insertion has been completed.

Preferably the add-on terminal block comprises two guide elements 225 symmetrically arranged on opposite sides of the protrusion 224 and designed to be inserted inside the seats 15 of the base terminal block so as to ensure a more stable coupling.

For both embodiments, the add-on terminal block has a dimension in the longitudinal direction X-X slightly bigger than the dimension in the longitudinal direction of the undercut 16 in the terminal block so as to leave exposed at least the access hole 12*a* for the actuating screw of the means for clamping the bottom wire 2 against the conductor lamina 20.

Figure 9:
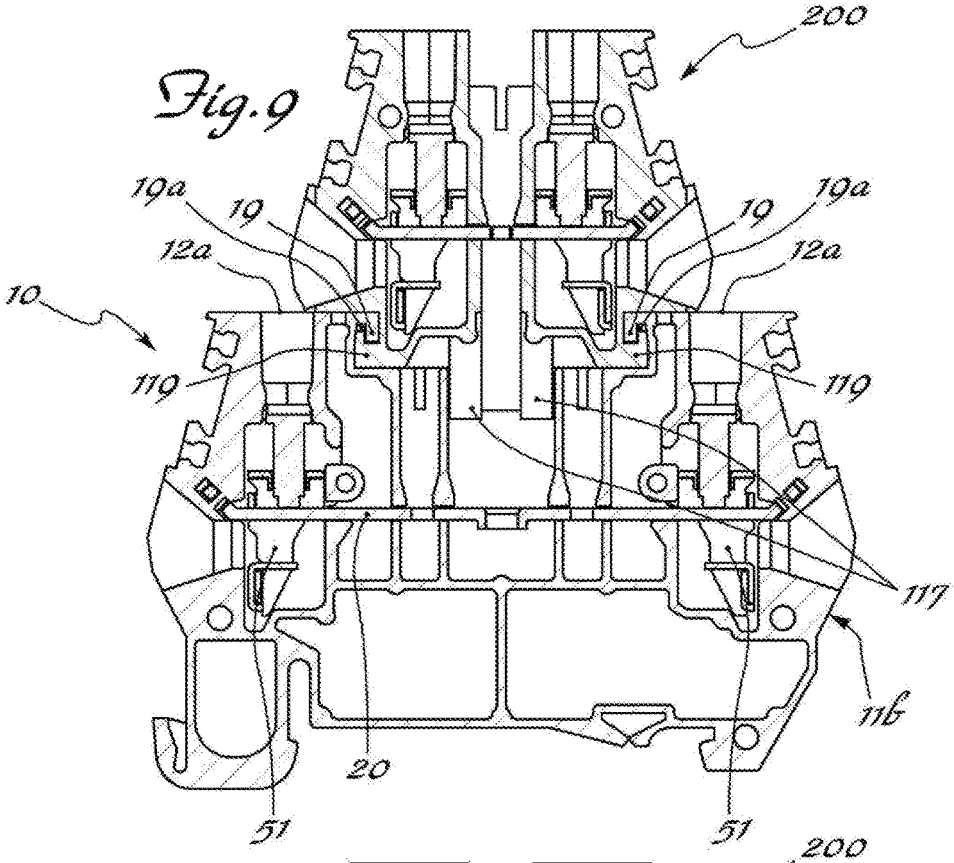
FIG. 9: shows a cross-sectional view, along a vertical plane, of a first example of a two-tier terminal block according to the present invention.
Figure 10:
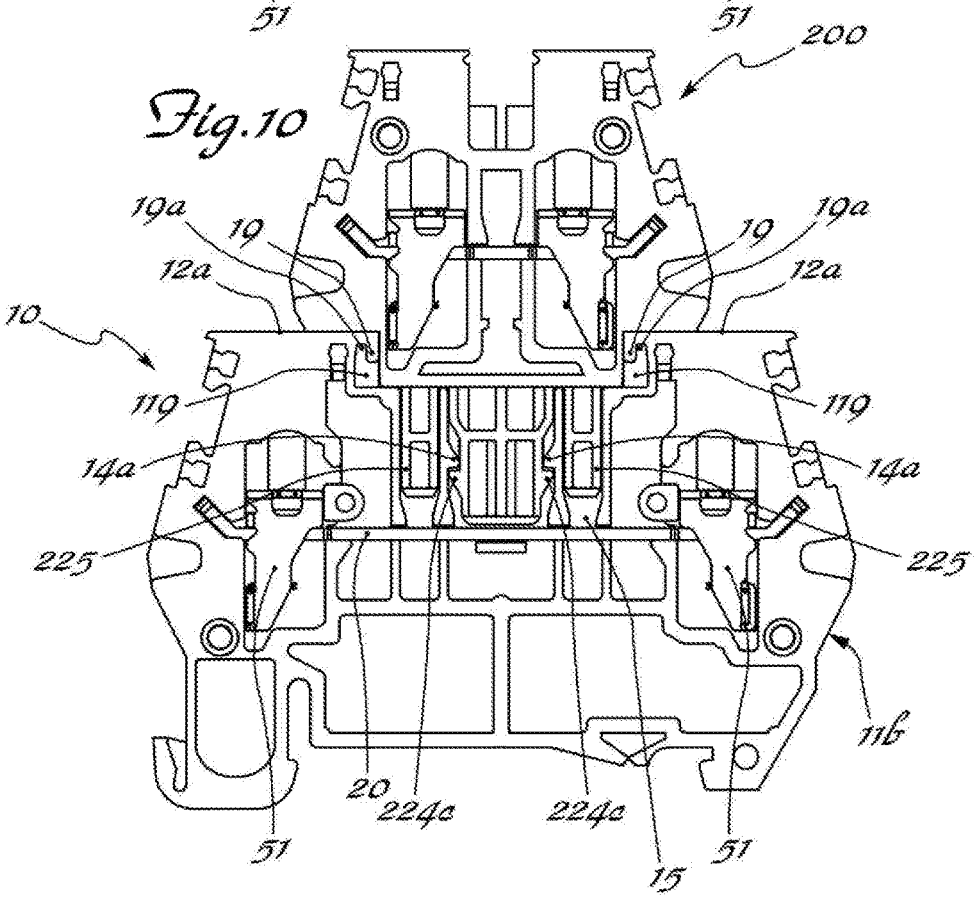
FIG. 10: shows a cross-sectional view, along a vertical plane, of a second example of a two-tier terminal block according to the present invention.

FIGS. 9 and 10 show the two different types of engaging arrangement which can be obtained with the different embodiments of the base terminal block and the add-on terminal block so as to form a two-tier terminal block assembly extending in the vertical direction Z-Z.

Once closed in the transverse direction with a cover, the two terminal blocks are mechanically coupled together in a fixed and irreversible manner, eliminating the risk of accidental extraction of the add-on terminal block in the vertical direction, with the consequent interruption of the electrical connections.

Figure 11:
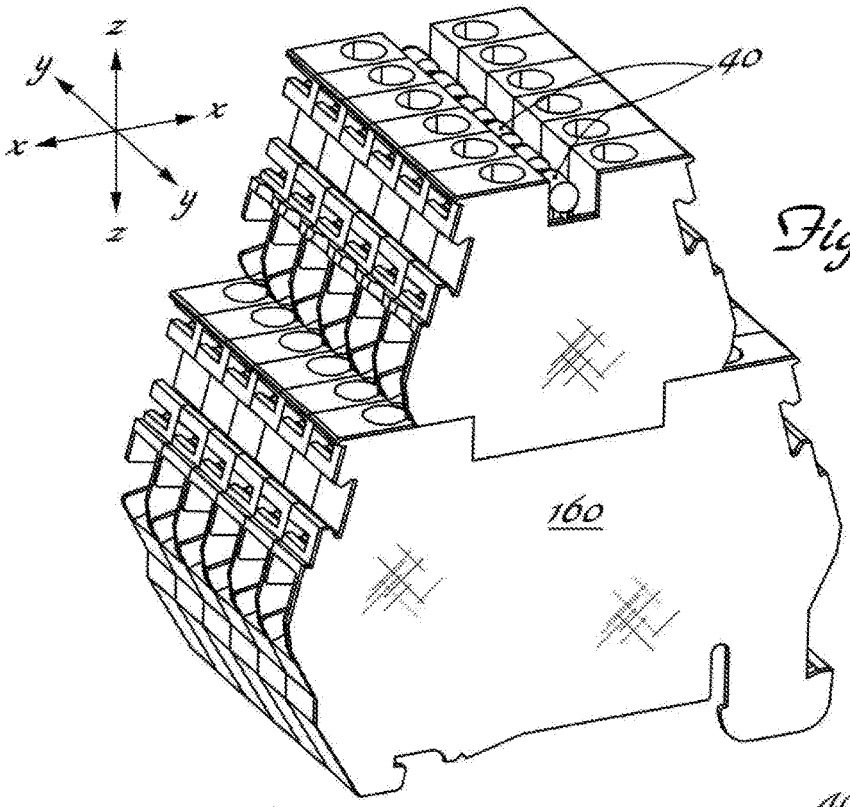
FIG. 11: shows a view of a plurality of two-tier terminal blocks according to the invention connected in the transverse direction and closed laterally.
Figure 12:
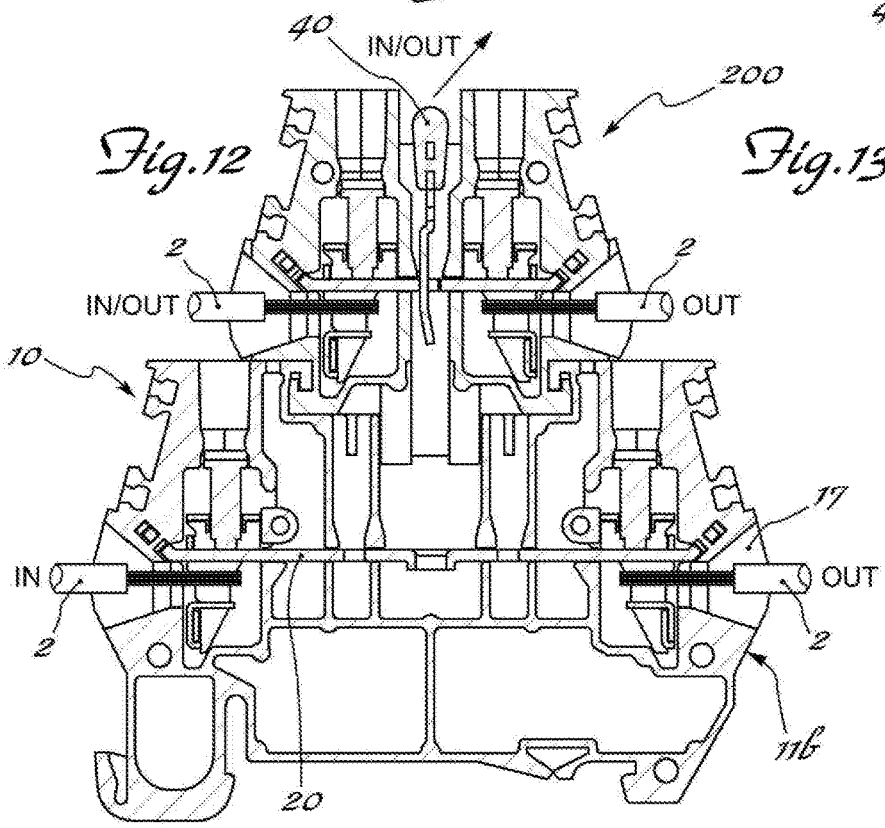
FIG. 12: shows a cross-section, similar to that of FIG. 9, with the upper terminal block complete with connecting jumper.
Figure 13:
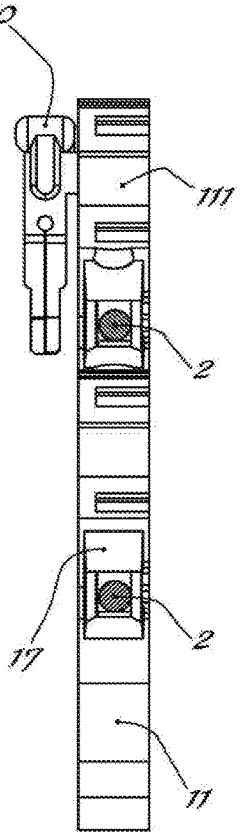
FIG. 13: shows a side view from the narrow side of the terminal block according to FIG. 12.
Figure 14:
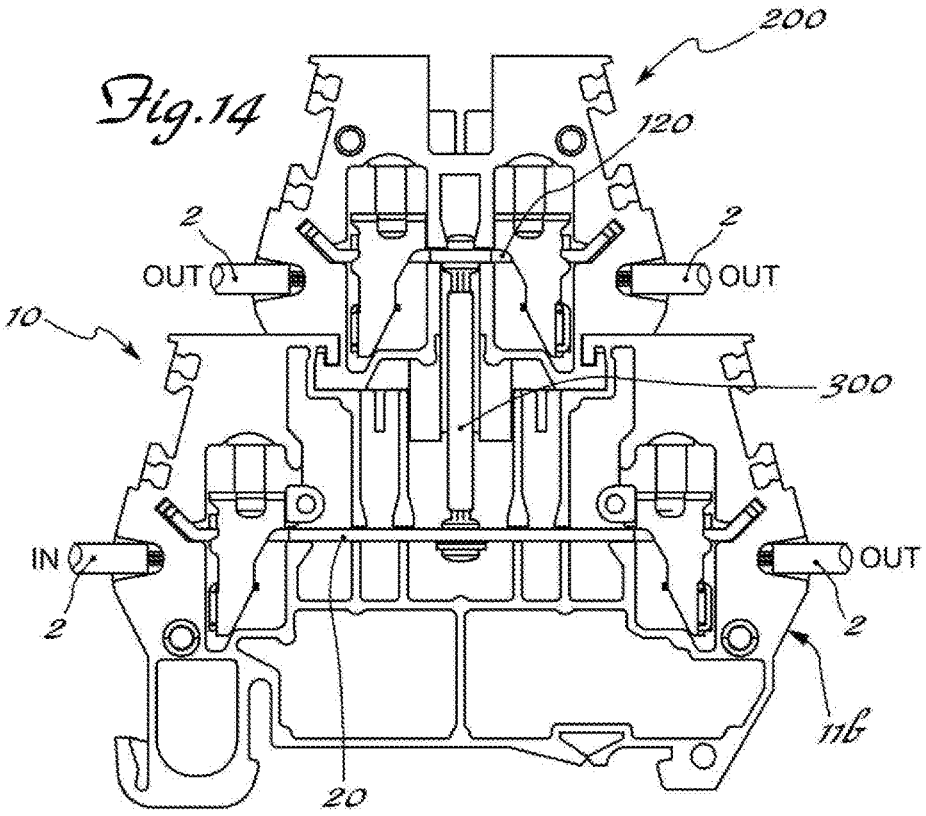
FIG. 14: shows a first variation of embodiment of the two-tier terminal block according to the invention.
Figure 15:
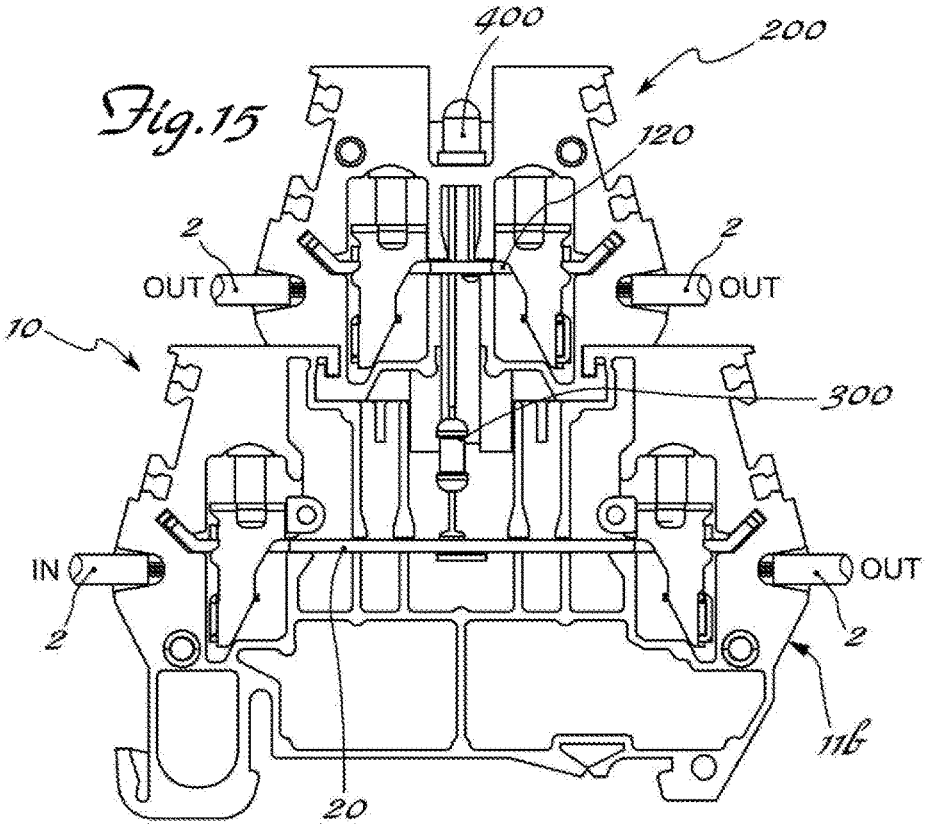
FIG. 15: shows a second variation of embodiment of the two-tier terminal block.

As shown in FIG. 11, it is envisaged that the two-tier terminal block comprises a closing cover 160 formed as one piece so as to close both the bottom base terminal block and the upper add-on terminal black with a single operating action, thus reducing both the need to diversify the component parts and the management and time required for the assembly steps.

As shown in the examples of FIGS. 12-15 with the two-tier terminal block structure, it is possible to perform numerous different electrical connections not only in the longitudinal direction X-X and the transverse direction Y-Y, but also in the vertical direction Z-Z (also in the preferred case where the base terminal block and add-on terminal block are left electrically independent of each other).

In detail the examples show:

a connection (FIG. 12, 13) of wires 2 both to the bottom tier and to the upper tier with a spring jumper 40 if necessary for performing the transverse connection Y-Y with an adjacent terminal block;

a connection (FIG. 14) of wires 2 both to the bottom tier and to the upper tier with electrical connection between the two tiers performed by means of a conductor 300 extending in the vertical direction Z-Z and connected to the two conductor laminae 20,120 of the bottom tier and upper tier, respectively;

a connection (FIG. 15) of wires 2 both to the bottom tier and to the upper tier with electrical connection between the two tiers being performed using different circuit components, such as a signalling device 400 for example of the LED type.

It is, therefore, clear how, with the base terminal block and the add-on terminal block according to the invention, it is possible to form two-tier terminal blocks which are able to increase the number of connections/branched junctions of a terminal block assembly for electric switchboards, without a substantial increase in the longitudinal and transverse dimensions and therefore of the overall volume of the terminal block assembly and associated housing container.

The invention claimed is:

1. A switchboard base terminal block for connecting electrical wires (2,2*a*) comprising an insulating body (10) formed by a substantially closed-ring frame (11) and configured so as to define at least one top side (11*a*) and a bottom side opposite in a vertical direction (Z-Z), and at least two respective flanks (11*b*) opposite in a longitudinal direction (X-X);

wherein inside the body (10) there is formed at least:

a first pair of seats (12) situated outermost in the longitudinal direction (X-X) towards the flanks (11*b*) and open in a transverse direction (Y-Y) of width of the terminal block, for housing means (50) for retaining wires (2), and during use communicating with the exterior via a first respective opening (12*a*) extending in the vertical direction (Z-Z) from the top wall (11*a*) of the frame (11); and a first space (14) centered on a central vertical axis (Z-Z) and bounded in the longitudinal direction (X-X) by respective first partitions (14*a*) extending parallel to the vertical direction (Z-Z) and vertically interrupted along a heightwise section so as to allow insertion, in the transverse direction (Y-Y), of a conductor lamina (20) for restoring the electrical continuity between the wires (2), wherein said first partitions (14*a*) are spaced from each other in the longitudinal direction (X-X) by an amount such as to define a size of the space suitable for housing a jumper (30) of the screw type (32);

an undercut (16) with base (16*a*) formed in the top side (11*a*) of the terminal block, said undercut having a first central opening (16*b*) for connecting with the exterior the central space (14) for insertion of the respective screw jumper (30), and means (19,19*a*; 14*c*) for coupling with corresponding means (119,119*a*; 224*c*) of an add-on terminal block for forming a two-tier terminal block in the vertical direction (Z-Z), wherein said coupling means are adapted for determining a stable and non-decouplable along the vertical direction coupling with corresponding coupling means of the add-on terminal block.

2. The base terminal block according to claim 1, wherein said coupling means comprise a pair of teeth (19) situated opposite each other and extending towards the inside of the undercut (16) from the opposite vertical edges (16*c*) of the undercut (16), said teeth (19) forming a respective L-shaped spaced seat (19*a*) formed in the respective vertical edge (16*c*).

3. The base terminal block according to claim 1, wherein said engagement means comprise at least one tooth (14*c*) extending from each partition (14*a*) of the central seat (14).

4. The base terminal block according to claim 1, further comprising a second pair of seats (15) which are respectively situated further inwards than the first pair of seats (12) with respect to the central vertical axis (Z-Z) and arranged symmetrically relative thereto and which are open on the visible top side (11*a*) of the terminal block and during use communicate externally via a respective opening (15*a*) extending in the vertical direction (Z-Z) from the front wall (11*a*) of the frame (11).

5. The base terminal block according to claim 4, further comprising two second openings (16*d*) symmetrically arranged on opposite sides of the central opening (16*b*) relative to the central vertical axis (Z-Z); said second openings (16*d*) forming the external connection of each of the second seats (15).

6. The base terminal block according to claim 1, wherein each second seat (15) is bounded in the longitudinal direction (X-X) by respective second partitions (15*a*) interrupted in the vertical direction (Z-Z) along a heightwise direction such as to allow the insertion of the conductor lamina (20); the partitions (15*a*) being spaced in the longitudinal direction (X-X) from the first partitions (14*a*) by an amount such as to define a size of the seats (15) suitable for housing a respective jumper (40) of the type with spring lugs (41).

7. The base terminal block according to claim 1, wherein said longitudinal conductor lamina (20) has a first central hole (21) with female thread (21*a*) designed to mate with the threading of the screw (32) of the jumper (30), and a pair of polygonal-shaped openings (23) symmetrically arranged on opposite sides of the central hole (21) relative to the central axis (Z-Z), said central hole (21) and openings (23) being respectively coaxial with the central space (14) and the lateral seats (15) for engagement respectively with the screw of a screw jumper (30) and with the lugs (41) of a spring jumper (40).

8. The base terminal block according to claim 7, wherein the central hole (21) has a collar (21*b*) deep-drawn in the vertical direction (Z-Z) for allowing further screwing of the screw (31) of the jumper (30).

9. The base terminal block according to claim 1, wherein said L-shaped seats (19*a*) are adapted for coupling with corresponding seats (119*a*) and projections (119) protruding outwards in the longitudinal direction (X-X) formed in the bottom part of the frame (111) of an add-on terminal block.

10. An assembly consisting of a base terminal block according to claim 1 and an add-on terminal block, wherein the base terminal block and the add-on terminal block are joined together by means of the respective coupling means (19; 119) so as to form a switchboard terminal block with two tiers in the vertical direction (Z-Z).

11. The assembly according to claim 10, wherein joining together is performed in the transverse direction (Y-Y).

12. The assembly according to claim 10, wherein joining together is performed in the vertical direction (Z-Z).

13. A switchboard add-on terminal block for connecting electrical wires (2,2*a*), comprising an insulating body (110) formed by a substantially closed-ring frame (111) and configured so as to define at least one top side (111*a*), at least one bottom side opposite to the top side and at least two respective flanks (111*b*) opposite each other in a longitudinal direction (X-X); inside the body (110) there being formed at least:

a first pair of seats (112) situated outermost in the longitudinal direction (X-X) towards the flanks (111*b*), symmetrically with respect to a central vertical axis (Z-Z), open in the transverse direction (Y-Y), suitable for housing means (50) for retaining wires (2) and during use communicating externally via a first respective opening (112*a*) extending in the vertical direction (Z-Z) from the top wall (111*a*) of the frame (111);

a space (114) centered on the central vertical axis (Z-Z) and bounded in the longitudinal direction (X-X) by respective partitions (114*a*) extending in the vertical direction (Z-Z) and vertically interrupted along a heightwise section so as to allow the insertion, in the transverse direction (Y-Y), of a conductor lamina (20) for restoring the electrical continuity between the wires (2), said partitions (114*a*) being spaced from each other in the longitudinal direction (X-X) by an amount such as to define a size of the space suitable for housing a jumper (40) of the elastic lugs type;

an undercut (116) with base (116*a*) formed in the front side (111*a*) of the terminal block, said undercut having a first central opening (116*d*) for externally connecting the central space (114) for insertion of the respective jumper; and means (119,119*a*; 224*c*) for coupling with corresponding means (19,19*a*; 214*c*) of a base terminal block for forming a two-tier terminal block in the vertical direction (Z-Z), wherein said coupling means are adapted for determining a stable and non-decouplable along the vertical direction coupling with corresponding coupling means of the base terminal block.

14. The add-on terminal block according to claim 13, wherein said coupling means comprise a pair of oppositely arranged teeth (119) extending from the bottom base outwards in the longitudinal direction (X-X), said teeth (119) forming a respective spaced seat (119*a*) in the form of an overturned L, said teeth (119) and spaced seat (19*a*) matching the corresponding seats (19*a*) and teeth (19) of a base terminal block, so as to allow joining together of the base terminal block with the add-on terminal block in the transverse direction (Y-Y).

15. The add-on terminal block according to claim 14, further comprising flanges (117) extending in the vertical direction (Z-Z) from the transverse peripheral edges of its bottom part and located in a central position with respect to the two projections (119).

16. The add-on terminal block according to claim 13, wherein said engagement means comprise at least one protrusion (224) projecting in the vertical direction (Z-Z) from the bottom surface of the add-on terminal block and provided with two teeth (224*c*) projecting outwards in the longitudinal direction (Y-Y).

17. The add-on terminal block according to claim 13, further comprising two guide elements (225) symmetrically arranged on opposite sides of the protrusion (224) and adapted to engage inside corresponding seats (15) of a base terminal block.

18. The add-on terminal block according to claim 13, wherein the bottom base has a dimension in the longitudinal direction (X-X) slightly bigger than the dimension in the longitudinal direction of the undercut (16) in the base terminal block.

19. The add-on terminal block according to claim 13, further comprising a longitudinal conductor lamina (120) which has a polygonal-shaped central opening (123) coaxial with the central space (114) for engagement with the contact lugs (41) of a respective jumper (40).

20. The add-on terminal block according to claim 13, further comprising a dimension in the vertical direction (Z-Z) smaller than the corresponding dimension of the base terminal block.

* * * * *